US010796631B2

(12) United States Patent
Hung et al.

(10) Patent No.: US 10,796,631 B2
(45) Date of Patent: Oct. 6, 2020

(54) PIXEL CIRCUIT AND OPERATING METHOD THEREOF

(71) Applicant: AU OPTRONICS CORPORATION, Hsin-Chu (TW)

(72) Inventors: Chia-Che Hung, Hsin-Chu (TW); Mao-Hsun Cheng, Hsin-Chu (TW); Chen-Chi Lin, Hsin-Chu (TW); Meng-Xi Chan, Hsin-Chu (TW); Ting-Wei Guo, Hsin-Chu (TW); Peng-Bo Xi, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/558,876

(22) Filed: Sep. 3, 2019

(65) Prior Publication Data

US 2020/0074919 A1 Mar. 5, 2020

(30) Foreign Application Priority Data

Sep. 4, 2018 (TW) ..... 107131030 A

(51) Int. Cl.
*G09G 3/32* (2016.01)

(52) U.S. Cl.
CPC ..... *G09G 3/32* (2013.01); *G09G 2300/043* (2013.01); *G09G 2300/0426* (2013.01); *G09G 2300/0439* (2013.01)

(58) Field of Classification Search
CPC ..... G09G 3/32–3291
See application file for complete search history.

(56) References Cited

U.S. PATENT DOCUMENTS

| | | | |
|---|---|---|---|
| 9,378,678 | B1 | 6/2016 | Lee et al. |
| 2012/0086694 | A1 | 4/2012 | Tseng et al. |
| 2016/0062522 | A1 | 3/2016 | Yang |

FOREIGN PATENT DOCUMENTS

| | | |
|---|---|---|
| CN | 105761673 | 7/2016 |
| TW | 201216244 | 4/2012 |

OTHER PUBLICATIONS

Taiwan Intellectual Property Office TIPO, Office action dated Jun. 21, 2019.

*Primary Examiner* — Sanjiv D. Patel
(74) *Attorney, Agent, or Firm* — WPAT, PC

(57) ABSTRACT

A pixel circuit applied to an uLED display including a LED, a first transistor~a sixth transistor and a capacitor. The LED is coupled between a first voltage and a first node. The first transistor is coupled between the first node and a second node. The second transistor is coupled between the second node and a second voltage lower than the first voltage. The third transistor is coupled between a third voltage and a third node. The fourth transistor is coupled between the third node and a fourth node. The fifth transistor is coupled between the fourth node and a fourth voltage. A terminal of the sixth transistor is coupled to the first node. The capacitor is coupled between the second node and the fourth node. The fourth transistor is controlled by a second control signal. The third transistor, the fifth transistor and the sixth transistor are controlled by a third control signal.

20 Claims, 6 Drawing Sheets

PIXEL CIRCUIT AND OPERATING METHOD THEREOF

BACKGROUND OF THE INVENTION

1. Field of the Invention

The invention relates to a display; in particular, to a pixel circuit and an operating method thereof applied to a micro light-emitting diode (uLED) display.

2. Description of the Prior Art

Generally, in a pixel circuit of a conventional active matrix organic light-emitting diode (AMOLED) display, a light-emitting diode is coupled to a ground voltage in a general configuration instead of being coupled to an operating voltage.

For example, as shown in FIG. 1, the pixel circuit 1 includes a light-emitting diode LED, a first transistor T1 to a fourth transistor T4 and a first capacitor C1 to a second capacitor C2. The third transistor T3 and the second transistor T2 are coupled in series between the first voltage (the operating voltage) OVDD and the first node N1; the first capacitor C1 is coupled to the second node N2 and the third node N3; the second node N2 is located between the gate of the first transistor T1 and the gate of the second transistor T2; the third node N3 is located between the fourth transistor T4 and the first node N1; the second capacitor C2 is coupled between the fourth node N4 and the first node N1; the fourth node N4 is located between the first voltage OVDD and the third transistor T3; the light-emitting diode LED is coupled between the first node N1 and the second voltage (the ground voltage) OVSS. The gate of the first transistor T1 is controlled by the first control signal SCN; the gate of the third transistor T3 is controlled by the second control signal EM; the gate of the fourth transistor T4 is controlled by the third control signal RST. The first transistor T1 is coupled to the data signal DAT; the fourth transistor T4 is coupled to the voltage signal VSU.

Please refer to FIG. 2. FIG. 2 illustrates a timing diagram of the first control signal SCN, the second control signal EM, the third control signal RST, the data signal DAT and the voltage signal VSU in FIG. 1.

As shown in FIG. 2, the first period t1, the second period t2, the third period t3 and the fourth period t4 are defined as a reset period, a compensation period, a data writing period, and a light-emitting period respectively.

During the first period (the reset period) t1, only the first control signal SCN and the third control signal RST are at high-level HL, and the second control signal EM and the voltage signal VSU are at low-level LL. The data signal DAT has a low-level reference voltage VREF.

During the second period (the compensation period) t2, only the first control signal SCN and the second control signal EM are at high-level HL, and the third control signal RST and the voltage signal VSU are at low-level LL and the data signal DAT has a low-level reference voltage VREF.

During the third period (the data writing period) t3, only the first control signal SCN is at high-level HL and the data signal DAT has a high-level data voltage VDAT, and the second control signal EM, the third control signal RST and the voltage signal VSU are at low-level LL.

During the fourth period (the light-emitting period) t4, only the second control signal EM is at high-level HL, and the first control signal SCN, the third control signal RST and the voltage signal VSU are at low-level LL and the data signal DAT has a low-level reference voltage VREF.

It can be seen from the above that the compensation period and the data writing period of the conventional pixel circuit 1 are separated from each other, that is to say, the compensation operation and the data writing operation are not performed simultaneously, resulting in a relatively short compensation time. In addition, the light-emitting diode current flowing through the light-emitting diode LED in the fourth period (the light-emitting period) t4 is not only related to the data voltage VDAT and the reference voltage VREF, but also related to the first capacitor C1, the second capacitor C2 and the capacitance of the light-emitting diode; that is to say, the light-emitting diode current will change with the equivalent capacitance of the light-emitting diode.

However, according to the experimental data, in the case that the cross-voltage is 0 volt, the capacitance values of the Red organic light-emitting diode, the Green organic light-emitting diode and the Blue organic light-emitting diode are 1 pF, 354 fF and 263 fF respectively, and the capacitance of the red organic light-emitting diode is not fixed before the cross-voltage is 0 volt, so that the conventional pixel circuit 1 is easily affected by the equivalent capacitance of the light-emitting element and becomes unstable.

SUMMARY OF THE INVENTION

Therefore, the invention provides a pixel circuit and an operating method thereof applied to a micro light-emitting diode (uLED) display to solve the above-mentioned problems occurred in the prior arts.

An embodiment of the invention is a pixel circuit. In this embodiment, the pixel circuit receives a first control signal, a second control signal and a third control signal. The pixel circuit includes a LED, a first transistor, a second transistor, a third transistor, a fourth transistor, a fifth transistor, a sixth transistor and a capacitor. The LED is coupled between a first voltage and a first node. The first transistor is coupled between the first node and a second node. The second transistor is coupled between the second node and a second voltage, wherein the second voltage is lower than the first voltage. The third transistor is coupled between a third voltage and a third node and configured to receive the third control signal and controlled by the third control signal. The fourth transistor is coupled between the third node and a fourth node and configured to receive the second control signal and controlled by the second control signal. The fifth transistor is coupled between the fourth node and a fourth voltage and configured to receive the third control signal and controlled by the third control signal. The sixth transistor has a terminal coupled to the first node and configured to receive the third control signal and controlled by the third control signal. The capacitor is coupled between the second node and the fourth node.

In an embodiment, the third voltage is a reference voltage and the fourth voltage is a data voltage.

In an embodiment, the third voltage is a data voltage and the fourth voltage is a reference voltage.

In an embodiment, when the pixel circuit is operated in a first compensation mode, another terminal of the sixth transistor is coupled to the first voltage.

In an embodiment, during a first period, the LED is not conducted, the first control signal and the third control signal are at high-level and the second control signal is at low-level, so that the fourth transistor is not conducted and the first transistor, the second transistor, the third transistor, the fifth transistor and the sixth transistor are conducted.

In an embodiment, the first node has the first voltage, the second node has the second voltage, the third node has the third voltage and the fourth node has the fourth voltage; a reset current flowing from the first node through the first transistor to the second node is related to the second voltage, the third voltage and a threshold voltage of the first transistor.

In an embodiment, during a second period, the LED is not conducted, the first control signal and the second control signal are at low-level and the third control signal is at high-level, so that the second transistor and the fourth transistor are not conducted and the first transistor, the third transistor, the fifth transistor and the sixth transistor are conducted.

In an embodiment, the first node has the first voltage, the second node has a voltage equal to the third voltage minus a threshold voltage of the first transistor, the third node has the third voltage and the fourth node has the fourth voltage; a cross-voltage across the capacitor equal to the fourth voltage minus the third voltage and plus the threshold voltage of the first transistor.

In an embodiment, during a third period, the LED is conducted, the first control signal and the second control signal are at high-level and the third control signal is at low-level, so that the third transistor, the fifth transistor and the sixth transistor are not conducted and the first transistor, the second transistor and the fourth transistor are conducted.

In an embodiment, a light-emitting diode current flowing the LED is related to the fourth voltage and the third voltage.

In an embodiment, when the pixel circuit is operated in a second compensation mode, another terminal of the sixth transistor is coupled to a sensing line of the uLED display.

In an embodiment, the first control signal and the third control signal are at high-level and the second control signal is at low-level, so that the fourth transistor is not conducted and the first transistor, the second transistor, the third transistor, the fifth transistor and the sixth transistor are conducted, and the LED is not conducted, the sensing line provides a detection current flowing through the sixth transistor, the first node, the first transistor, the second node and the second transistor in order, and the detection current is related to the second voltage, the third voltage and a threshold voltage of the first transistor.

In an embodiment, the first control signal and the second control signal are at low-level and the third control signal is at high-level, so that the first transistor, the second transistor and the fourth transistor are not conducted and the third transistor, the fifth transistor and the sixth transistor are conducted, the LED is conducted, a reference current flows through the LED, the first node, the sixth transistor and the sensing line to form a sensing voltage, and the sensing voltage is related to the first voltage and a cross-voltage across the LED.

Another embodiment of the invention is a pixel circuit operating method. In this embodiment, the pixel circuit operating method is used for operating a pixel circuit applied to a micro light-emitting diode (uLED) display. The pixel circuit includes a light-emitting diode (LED), a first transistor, a second transistor, a third transistor, a fourth transistor, a fifth transistor, a sixth transistor and a capacitor. The LED, the first transistor and the second transistor are coupled in series between a first voltage and a second voltage lower than the first voltage. The third transistor, the fourth transistor and the fifth transistor are coupled in series between a third voltage and a fourth voltage. The sixth transistor is coupled to a first node between the LED and the first transistor and the capacitor is coupled to a second node between the first transistor and the second transistor. A gate of the first transistor is coupled to a third node between the third transistor and the fourth transistor and the capacitor is also coupled to a fourth node between the fourth transistor and the fifth transistor. The pixel circuit operating method includes steps of: providing a first control signal to the second transistor to control the operation of the second transistor; providing a second control signal to the fourth transistor to control the operation of the fourth transistor; and providing a third control signal to the third transistor, the fifth transistor and the sixth transistor to control the operation of the third transistor, the fifth transistor and the sixth transistor.

Compared to the prior art, the invention provides a pixel circuit and a method for operating the same for a micro light-emitting diode (uLED) display. Since its LED current is independent of the equivalent capacitance of the LED, the defect that the pixel circuit in the prior art is easily affected by the equivalent capacitance of the light-emitting diode can be effectively improved. And, the pixel circuit of the invention can perform compensation operation and data writing operation simultaneously, so that the compensation time can be greatly increased. In addition, the pixel circuit of the invention can adopt an internal self-compensation mode or an external compensation mode as needed, thereby increasing flexibility in practical applications.

The advantage and spirit of the invention may be understood by the following detailed descriptions together with the appended drawings.

BRIEF DESCRIPTION OF THE APPENDED DRAWINGS

Figure 5A:
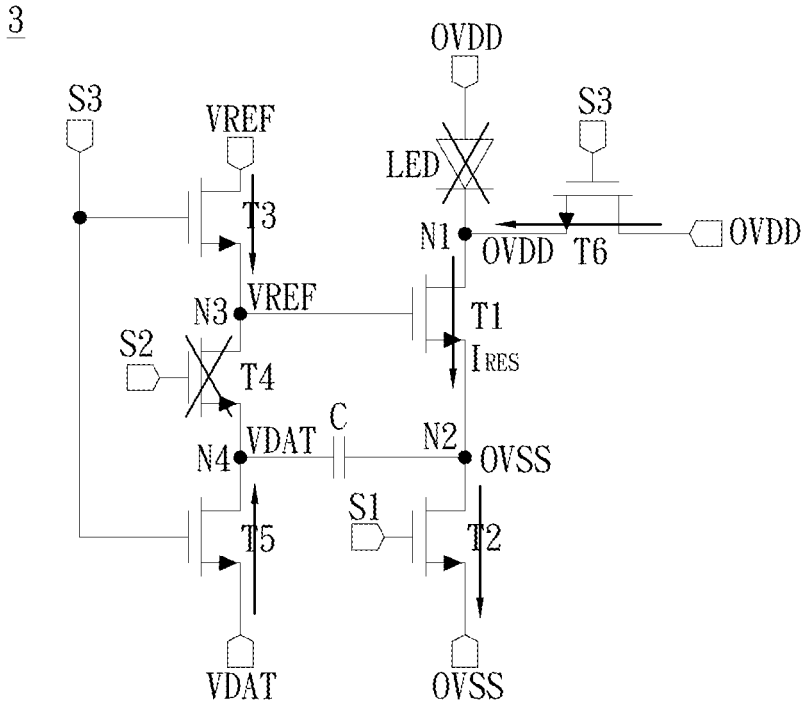
Figure 5B:
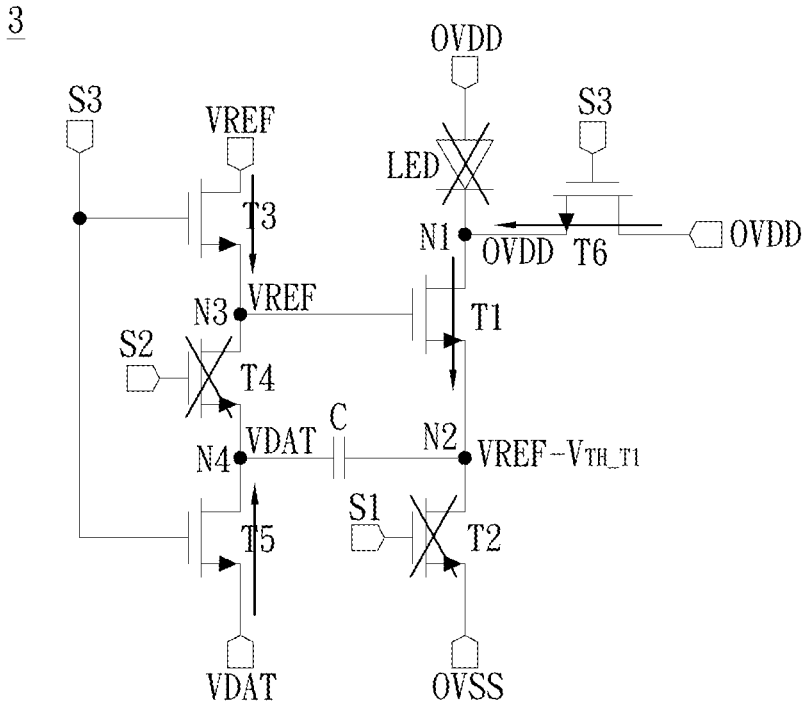
Figure 5C:
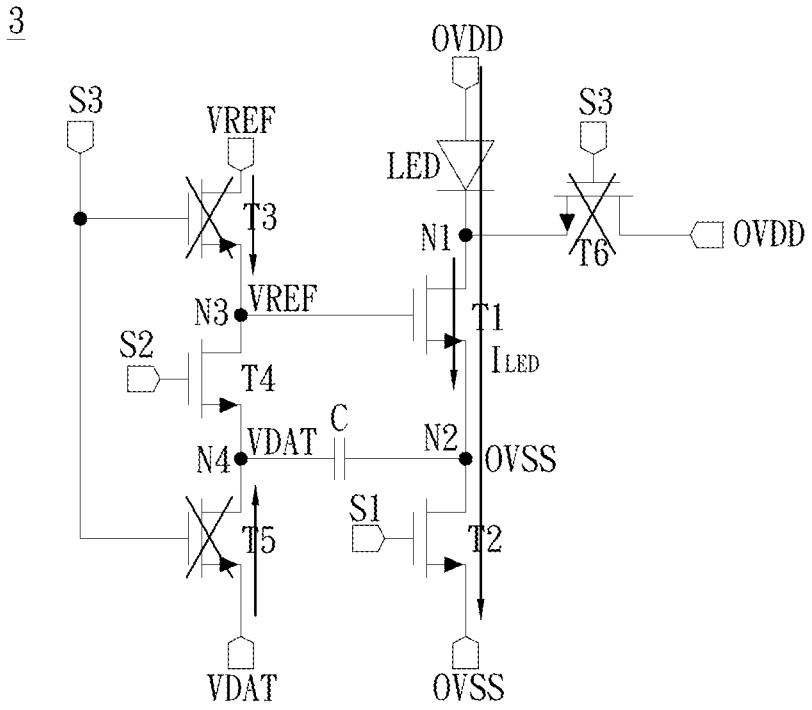

FIG. 5A~FIG. 5C illustrate schematic diagrams of the pixel circuit 3 operated in the internal self-compensation mode during the first period t1~the third period t3 respectively.

Figure 6A:
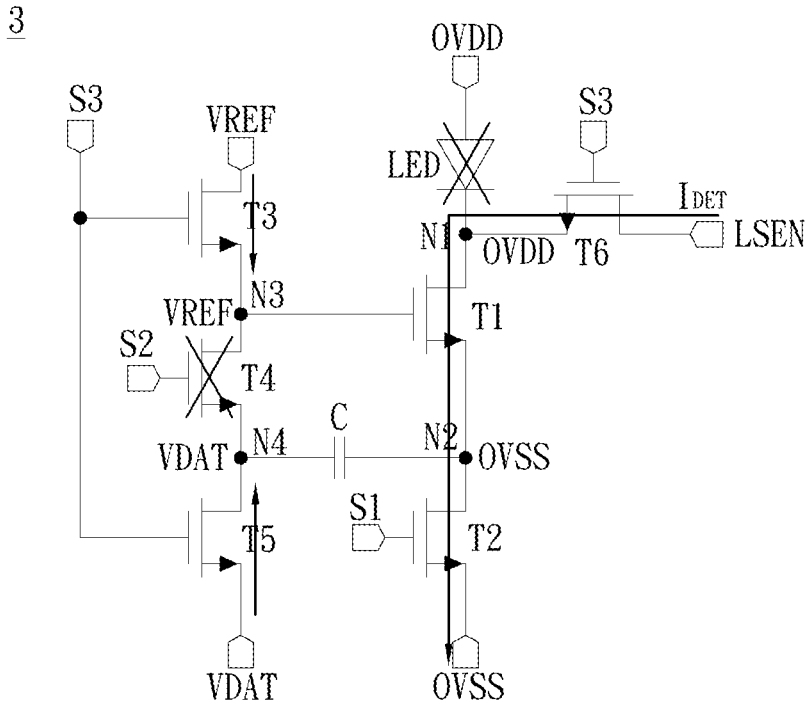
Figure 6B:
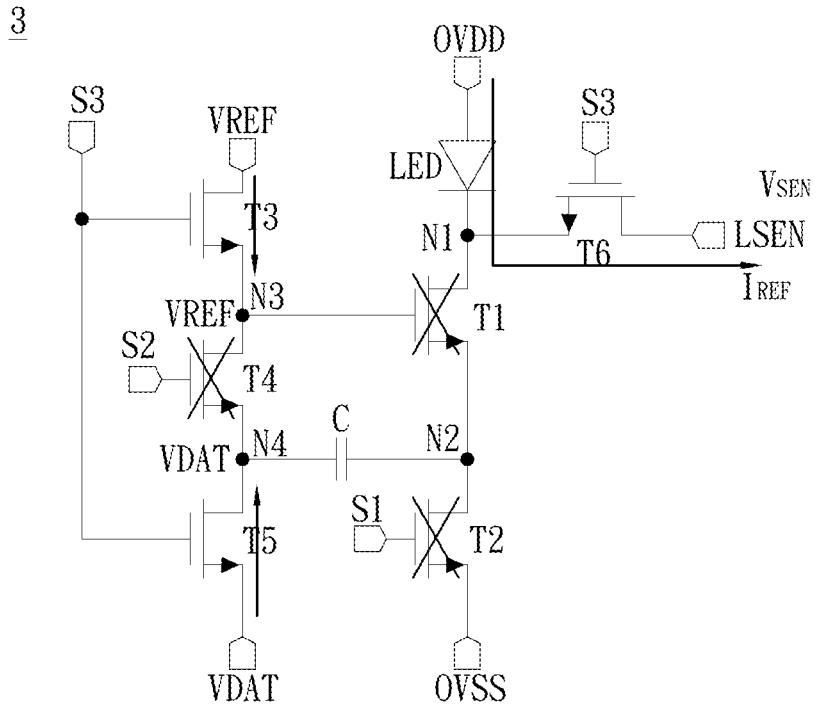

FIG. 6A~FIG. 6B illustrate schematic diagrams of the pixel circuit 3 operated in the external compensation mode during the first period t1~the second period t2 respectively.

Figure 7:
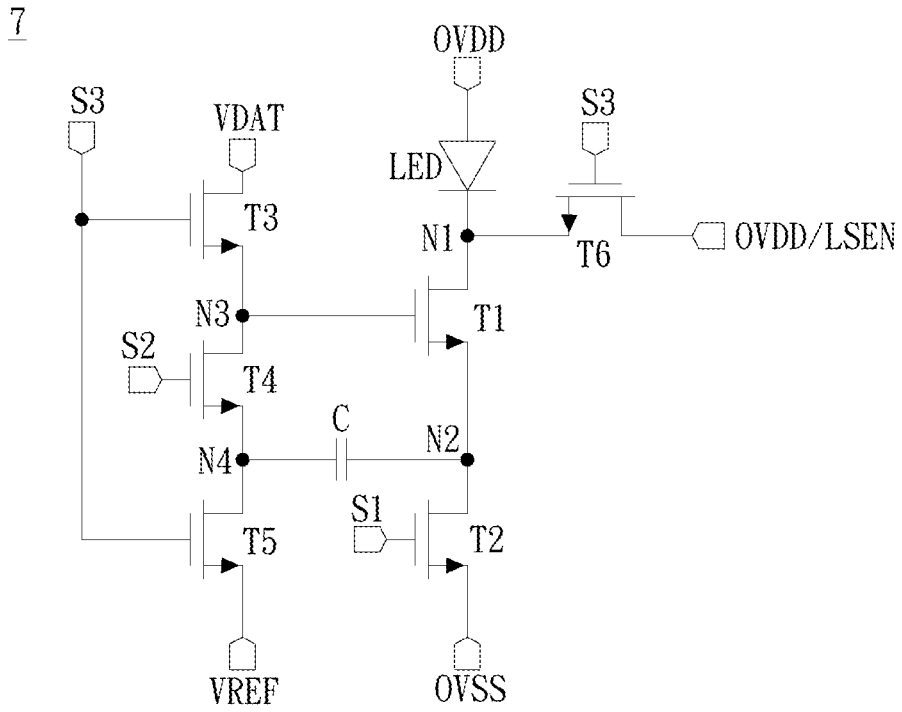

FIG. 7 illustrates a schematic diagram of the pixel circuit 7 in another preferred embodiment of the invention.

Figure 8:
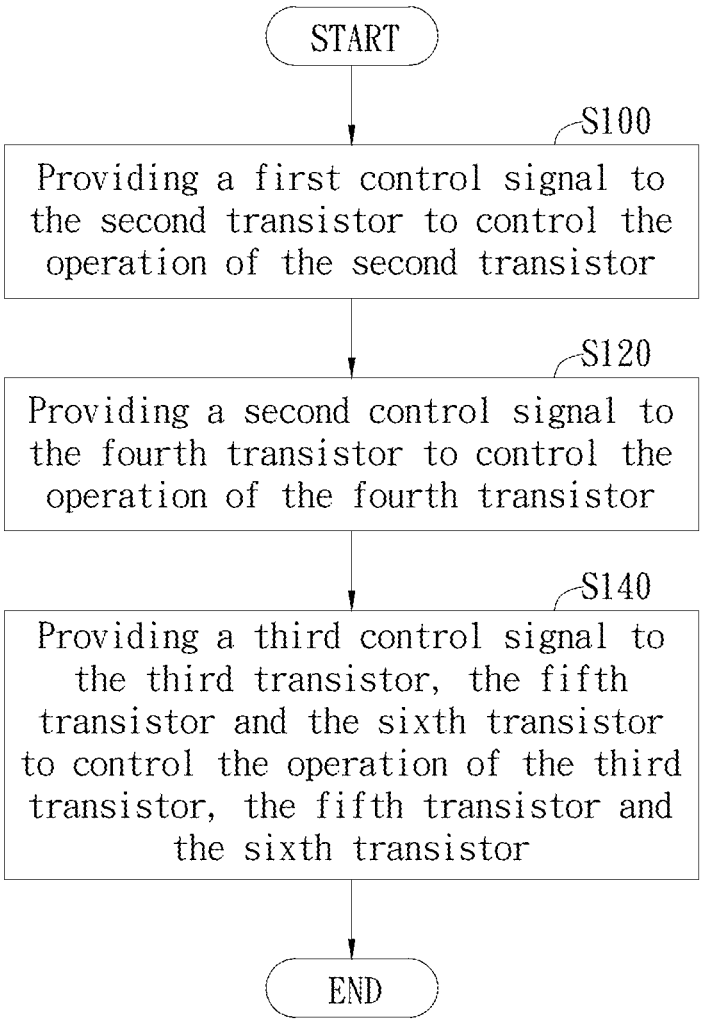

FIG. 8 illustrates a flowchart of the pixel circuit operating method in another preferred embodiment of the invention.

DETAILED DESCRIPTION OF THE INVENTION

The invention will be described more fully hereinafter with reference to the accompanying drawings. Exemplary embodiments of the present invention are shown in the accompanying drawings. The described embodiments may be modified in various different ways, without departing from the spirit or scope of the invention. The described embodiments may be modified in various different ways, without departing from the spirit or scope of the invention.

In the drawings, a portion of the area is enlarged for the sake of clarity. Throughout the specification, the same reference numerals denote the same elements. It will be understood that when an element such as a region or a substrate is referred to as being "on" or "connected (or "coupled") or "electrically connected" to another element, it can be On or in connection with (or referred to as coupling) or electrical connection to another element, or an intermediate element may also be present. In contrast, when an element is referred to as "directly on" or "directly connected to" another element. As used herein, "connected (or referred to as coupled)" may refer to both physical and/or electrical connections.

A preferred embodiment of the invention is a pixel circuit. In this embodiment, the pixel circuit is applied to the uLED display and the pixel circuit having the "6T1C" structure formed by six transistors and a capacitor, and the light-emitting diode is arranged in an inverted configuration, that is, the light-emitting diode is coupled to the operating voltage instead of the ground voltage, but not limited to this.

Figure 1:
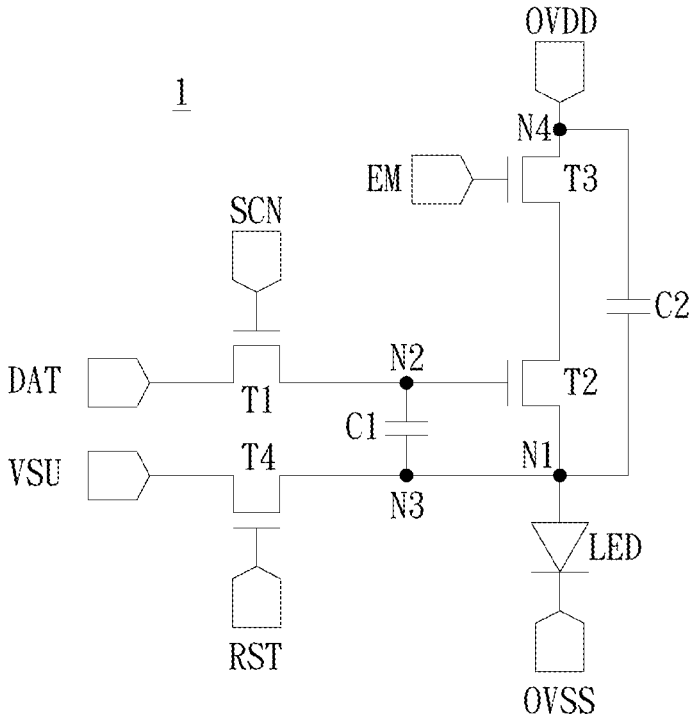
FIG. 1 (PRIOR ART)
FIG. 1 illustrates a schematic diagram of the pixel circuit of the conventional active matrix organic light-emitting diode (AMOLED) display.
Figure 2:
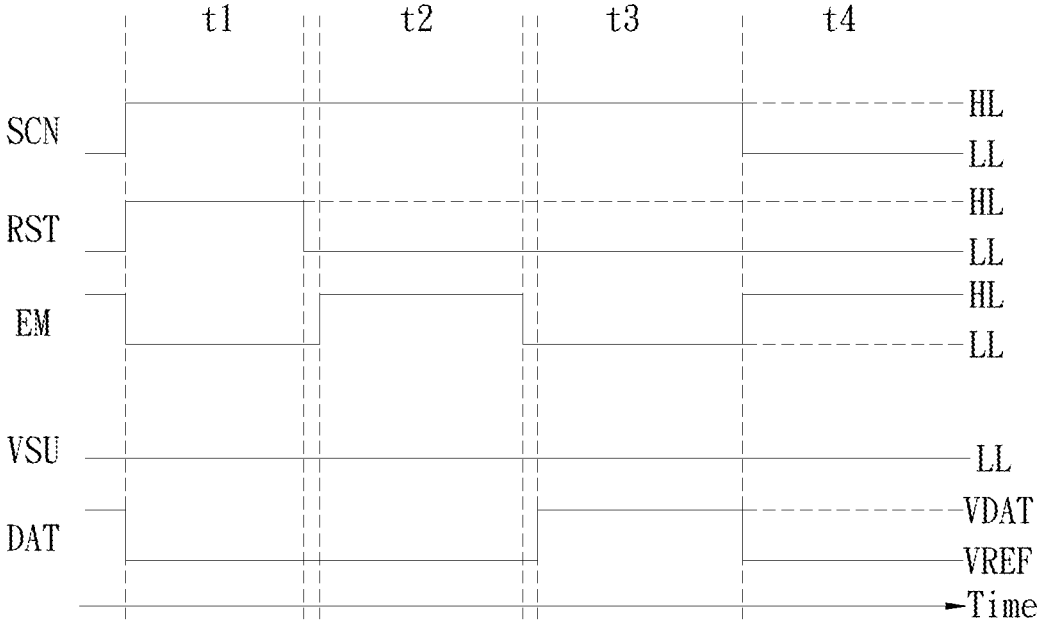
FIG. 2 (PRIOR ART)
FIG. 2 illustrates timing diagrams of the first control signal SCN, the second control signal EM, the third control signal RST, the data signal DAT and the voltage signal VSU in FIG. 1.
Figure 3:
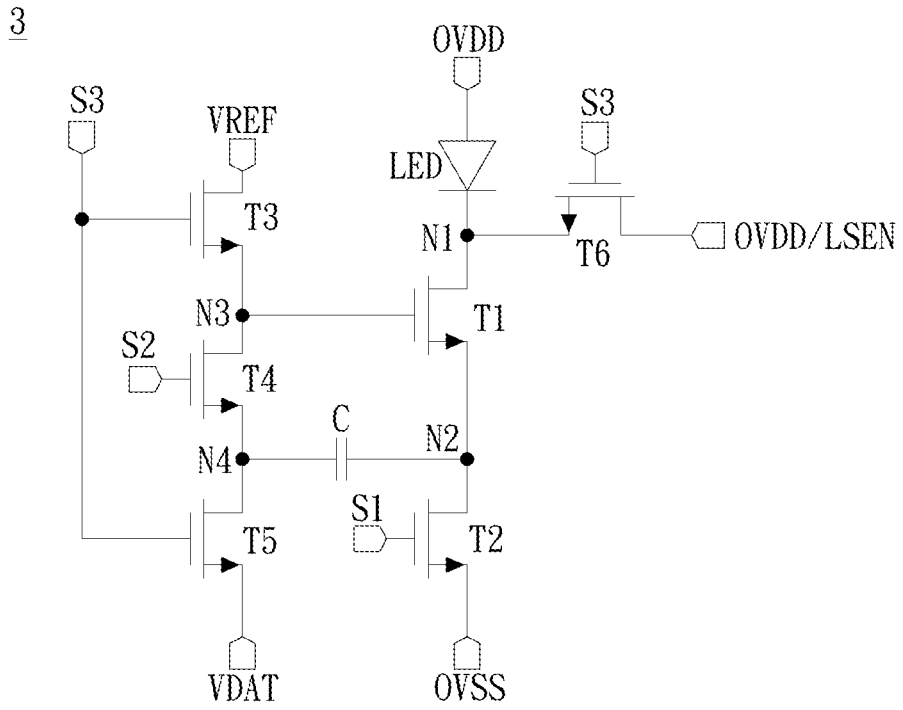
FIG. 3 illustrates a schematic diagram of the pixel circuit 3 in a preferred embodiment of the invention.

Please refer to FIG. 3. FIG. 3 illustrates a schematic diagram of the pixel circuit 3 in this embodiment. As shown in FIG. 3, the pixel circuit 3 includes a light-emitting diode LED, a first transistor T1, a second transistor T2, a third transistor T3, a fourth transistor T4, a fifth transistor T5, and a sixth transistor T6 and a capacitor C.

The light-emitting diode LED is coupled between the first voltage OVDD and the first node N1. The first transistor T1 is coupled between the first node N1 and the second node N2. The second transistor T2 is coupled between the second node N2 and the second voltage OVSS. In this embodiment, the second voltage OVSS is lower than the first voltage OVDD. For example, the first voltage OVDD can be an operating voltage and the second voltage OVSS can be a ground voltage, but not limited to this.

The third transistor T3 is coupled between the third voltage VREF and the third node N3, and the gate of the third transistor T3 receives the third control signal S3 and is controlled by the third control signal S3. The fourth transistor T4 is coupled between the third node N3 and the fourth node N4, and the gate of the fourth transistor T4 receives the second control signal S2 and is controlled by the second control signal S2. In this embodiment, the third voltage VREF coupled to the third transistor T3 can be a reference voltage, but not limited to this.

The fifth transistor T5 is coupled between the fourth node N4 and the fourth voltage VDAT, and the gate of the fifth transistor T5 receives the third control signal S3 and is controlled by the third control signal S3. One terminal of the sixth transistor T6 is coupled to the first node N1, and the gate of the sixth transistor T6 receives the third control signal S3 and is controlled by the third control signal S3. The capacitor C is coupled between the second node N2 and the fourth node N4. In this embodiment, the fourth voltage VDAT coupled to the fifth transistor T5 can be a data voltage, but not limited to this.

It should be noted that the third voltage VREF in this embodiment is the reference voltage and the fourth voltage VDAT is the data voltage, and the other terminal of the sixth transistor T6 can be selectively coupled to the first voltage OVDD or coupled to the sensing line LSEN of the LED display according to different compensation modes. Since the pixel circuit 3 can adopt an internal self-compensation mode or an external compensation mode as needed, the flexibility in practical applications can be increased.

Figure 4:
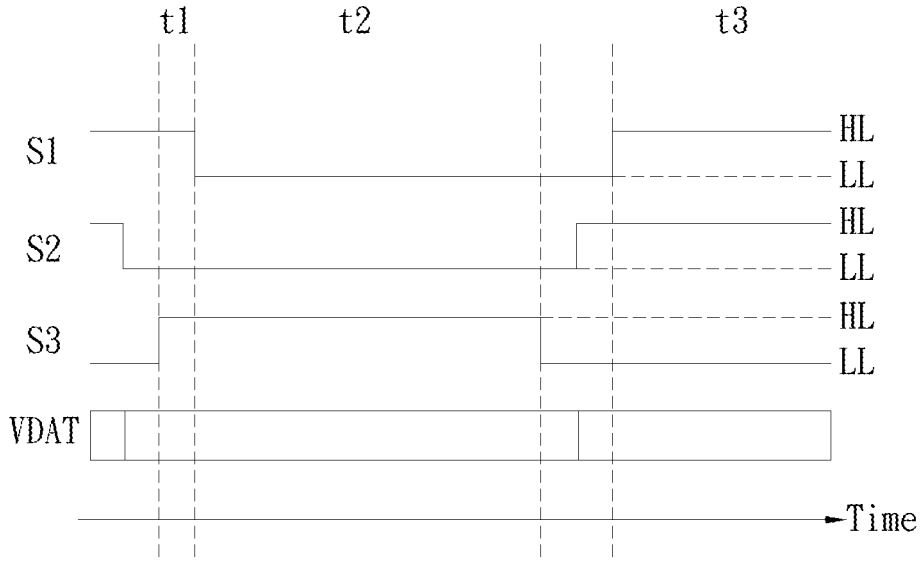
FIG. 4 illustrates timing diagrams of the first control signal S1, the second control signal S2, the third control signal S3 and the fourth voltage VDAT in FIG. 3.

Next, please refer to FIG. 4. FIG. 4 illustrates a timing diagram of the first control signal S1, the second control signal S2, the third control signal S3 and the fourth voltage VDAT in FIG. 3. It should be noted that the first period t1, the second period t2 and the third period t3 in FIG. 4 are defined as a reset period, a compensation and data writing period, and a light-emitting period respectively.

During the first period (the reset period) t1, the first control signal S1 and the third control signal S3 are at high-level HL and the second control signal S2 is at low-level LL, so that the fourth transistor T4 is not conducted and the first transistor T1, the second transistor T2, the third transistor T3, the fifth transistor T5 and the sixth transistor T6 are conducted.

During the second period (the compensation and data writing period) t2, the first control signal S1 and the second control signal S2 are at low-level LL and the third control signal S3 is at high-level HL, so that the second transistor T2 and the fourth transistor T4 are not conducted and the first transistor T1, the third transistor T3, the fifth transistor T5 and the sixth transistor T6 are conducted.

During the third period (the light-emitting period) t3, the first control signal S1 and the second control signal S2 are at high-level HL and the third control signal S3 is at low-level LL, so that the third transistor T3, the fifth transistor T5 and the sixth transistor T6 are not conducted and the first transistor T1, the second transistor T2 and the fourth transistor T4 are conducted.

Next, the conditions of the pixel circuit 3 operating in the internal self-compensation mode and the external compensation mode will be described.

In an embodiment, please refer to FIG. 5A~FIG. 5C. FIG. 5A~FIG. 5C illustrate schematic diagrams of the pixel circuit 3 operating in the internal self-compensation mode during the first period t1 to the third period t3 respectively. It should be noted that when the pixel circuit 3 operates in the internal self-compensation mode, another terminal of the sixth transistor T6 is coupled to the first voltage OVDD.

As shown in FIG. 4 and FIG. 5A, during the first period (the reset period) t1, the LED is not turned on (indicated by X in FIG. 5A), the first control signal S1 and the third control signal S3 is at high-level HL and the second control signal S2 is at low-level LL, so that the fourth transistor T4 is not conducted (indicated by X in FIG. 5A) and the first transistor T1 and the second transistor T2, the third transistor T3, the fifth transistor T5 and the sixth transistor T6 are conducted.

Therefore, during the first period (the reset period) t1, the first node N1 has the first voltage OVDD, the second node N2 has the second voltage OVSS, the third node N3 has the third voltage VREF and the fourth node N4 has a fourth voltage VDAT.

It should be noted that the reset current IRES flowing from the first node N1 through the first transistor T1 to the second node N2 during the first period (the reset period) t1 is related to the second voltage OVSS, the third voltage VREF and the threshold voltage ($V_{TH_T1}$) of the first transistor T1; for example, the reset current IRES is proportional to $(VREF-OVSS-V_{TH_T1})^2$, but not limited to this.

As shown in FIG. 4 and FIG. 5B, during the second period (the compensation and data writing period) t2, the LED is not turned on (indicated by X in FIG. 5B), the first control signal S1 and the second control signal S2 are at low-level LL and the third control signal S3 is at high-level HL, so that the second transistor T2 and the fourth transistor T4 are not conducted (indicated by X in FIG. 5B) and the first transistor T1, the third transistor T3, the fifth transistor T5 and the sixth transistor T6 are conducted.

Therefore, during the second period (the compensation and data writing period) t2, the first node N1 has the first voltage OVDD, and the voltage of the second node N2 is equal to the third voltage VREF minus the threshold voltage $V_{TH_T1}$ of the first transistor T1. The third node N3 has the third voltage VREF and the fourth node N4 has the fourth voltage VDAT.

It should be noted that during the second period (the compensation and data writing period) t2, the cross-voltage (Vc) across the capacitor C is equal to the fourth voltage VDAT minus the third voltage VREF and plus the threshold voltage $V_{TH_T1}$ of the first transistor T1; that is, $Vc=VDAT-VREF+V_{TH_T1}$, but not limited to this. In addition, since the pixel circuit 3 can simultaneously perform the operations of compensation and data writing during the second period (the compensation and data writing period) t2, the compensation time can be greatly increased to effectively improve the shortcoming of the insufficient compensation time in the prior art.

As shown in FIG. 4 and FIG. 5C, during the third period (the light-emitting period) t3, the LED is turned on, the first control signal S1 and the second control signal S2 are at high-level HL and the third control signal S3 is at low-level LL, so that the third transistor T3, the fifth transistor T5 and the sixth transistor T6 are not conducted (indicated by X in FIG. 5C) and the first transistor T1 and the second transistor T2 and the fourth transistor T4 are conducted.

It should be noted that during the third period (the light-emitting period) t3, the LED current ILED flowing through the LED is related to the fourth voltage VDAT and the third voltage VREF; for example, the LED current ILED is proportional to $(VDAT-VREF)^2$, but not limited to this. Therefore, the LED current ILED in this embodiment is independent of the equivalent capacitance of the LED, so that the defect that the pixel circuit in the prior art is easily affected by the equivalent capacitance of the light-emitting diode can be effectively improved.

In another embodiment, please refer to FIG. 6A and FIG. 6B. FIG. 6A and FIG. 6B illustrate schematic diagrams of the pixel circuit 3 operating in the external compensation mode during the first period t1 and the second period t2 respectively. It should be noted that when the pixel circuit 3 operates in the external compensation mode, another terminal of the sixth transistor T6 is coupled to the sensing line LSEN of the uLED display.

As shown in FIG. 6A, during the first period t1, the LED is not turned on (indicated by X in FIG. 6A), the first control signal S1 and the third control signal S3 are at high-level and the second control signal S2 is at low-level, so that the fourth transistor T4 is not conducted (indicated by X in FIG. 6A) and the first transistor T1, the second transistor T2, the third transistor T3, the fifth transistor T5 and the sixth transistor T6 are conducted.

It should be noted that during the first period t1, the detection current $I_{DET}$ provided from the sensing line LSEN of the uLED display sequentially flows through the sixth transistor T6, the first node N1, the first transistor T1, the second node N2, the second transistor T2 to the second voltage OVSS, and the detection current IDET is related to the second voltage OVSS, the third voltage VREF and the threshold voltage $V_{TH_T1}$ of the first transistor T1; for example, the detection current IDET is proportional to $(VREF-OVSS-V_{TH_T1})^2$, but not limited to this.

As shown in FIG. 6B, during the second period t2, the LED is turned on, the first control signal S and the second control signal S2 are at low-level, and the third control signal S3 is at high-level, so that the first transistor T1, the second transistor T2 and the fourth transistor T4 are not conducted (indicated by X in FIG. 6B), and the third transistor T3, the fifth transistor T5 and the sixth transistor T6 are conducted.

It should be noted that, during the second period t2, the reference current IREF flows from the first voltage OVDD through the light-emitting diode LED, the first node N1, the sixth transistor T6 to the sensing line LSEN to form a sensing voltage $V_{SEN}$, and the sensing voltage $V_{SEN}$ is related to the first voltage OVDD and the cross-voltage (VLED) across the light-emitting diode LED; for example, the sensing voltage $V_{SEN}=OVDD-VLED$, but not limited to this.

Please refer to FIG. 7. FIG. 7 illustrates a schematic diagram of the pixel circuit 7 according to another preferred embodiment of the invention.

It should be noted that the structure and operation of the pixel circuit 7 in FIG. 7 are basically the same as the structure and operation of the pixel circuit 3 in FIG. 3, and the difference between them is only that the third transistor T3 of the pixel circuit 3 is coupled to the reference voltage and the fifth transistor T5 is coupled to the data voltage, but the third transistor T3 of the pixel circuit 7 of FIG. 7 is coupled to the data voltage and the fifth transistor T5 is coupled to the reference voltage; that is, the data voltage and the reference voltage in the pixel circuit 7 and the pixel circuit 3 are mutually adjusted.

Since the light-emitting diode current ILED flowing through the light-emitting diode LED is related to the third voltage coupled to the third transistor T3 and the fourth voltage coupled to the fifth transistor T5, the light-emitting diode current ILED of the pixel circuit 7 is proportional to $(VREF-DAT)^2$; that is, the light-emitting diode current ILED is independent of the equivalent capacitance of the light-emitting diode LED, so that the defect that the pixel circuit in the prior art is easily affected by the equivalent capacitance of the light-emitting diode can be effectively improved.

Another embodiment of the invention is a pixel circuit operating method. In this embodiment, the pixel circuit operating method is used for operating a pixel circuit applied to a micro light-emitting diode (uLED) display, but not limited to this.

The pixel circuit includes a light-emitting diode (LED), a first transistor, a second transistor, a third transistor, a fourth transistor, a fifth transistor, a sixth transistor and a capacitor. The LED, the first transistor and the second transistor are coupled in series between a first voltage and a second voltage lower than the first voltage. The third transistor, the fourth transistor and the fifth transistor are coupled in series between a third voltage and a fourth voltage. The sixth transistor is coupled to a first node between the LED and the first transistor and the capacitor is coupled to a second node between the first transistor and the second transistor. A gate of the first transistor is coupled to a third node between the third transistor and the fourth transistor and the capacitor is also coupled to a fourth node between the fourth transistor and the fifth transistor.

Please refer to FIG. 8. FIG. 8 illustrates the flowchart of the pixel circuit operating method in this embodiment.

As shown in FIG. 8, the pixel circuit operating method includes the following steps of:

Step S100: providing a first control signal to the second transistor to control the operation of the second transistor;

Step S120: providing a second control signal to the fourth transistor to control the operation of the fourth transistor; and Step S140: providing a third control signal to the third transistor, the fifth transistor and the sixth transistor to control the operation of the third transistor, the fifth transistor and the sixth transistor.

For the detailed operation of the pixel circuit operation method, reference can be made to the related text and diagram description of the above embodiments, and the details are not described herein.

Compared to the prior art, the invention provides a pixel circuit and a method for operating the same for a micro light-emitting diode (uLED) display. Since its LED current is independent of the equivalent capacitance of the LED, the defect that the pixel circuit in the prior art is easily affected by the equivalent capacitance of the light-emitting diode can be effectively improved. And, the pixel circuit of the invention can perform compensation operation and data writing operation simultaneously, so that the compensation time can be greatly increased. In addition, the pixel circuit of the invention can adopt an internal self-compensation mode or an external compensation mode as needed, thereby increasing flexibility in practical applications.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A pixel circuit, applied to a micro light-emitting diode (uLED) display, the pixel circuit receiving a first control signal, a second control signal and a third control signal, the pixel circuit comprising:

a light-emitting diode (LED), coupled between a first voltage and a first node;

a first transistor, coupled between the first node and a second node;

a second transistor, coupled between the second node and a second voltage, wherein the second voltage is lower than the first voltage;

a third transistor, coupled between a third voltage and a third node and configured to receive the third control signal and controlled by the third control signal;

a fourth transistor, coupled between the third node and a fourth node and configured to receive the second control signal and controlled by the second control signal;

a fifth transistor, coupled between the fourth node and a fourth voltage and configured to receive the third control signal and controlled by the third control signal;

a sixth transistor having a terminal coupled to the first node and configured to receive the third control signal and controlled by the third control signal; and a capacitor, coupled between the second node and the fourth node.

2. The pixel circuit of claim 1, wherein the third voltage is a reference voltage and the fourth voltage is a data voltage.

3. The pixel circuit of claim 1, wherein the third voltage is a data voltage and the fourth voltage is a reference voltage.

4. The pixel circuit of claim 1, wherein when the pixel circuit is operated in a first compensation mode, another terminal of the sixth transistor is coupled to the first voltage.

5. The pixel circuit of claim 4, wherein during a first period, the LED is not conducted, the first control signal and the third control signal are at high-level and the second control signal is at low-level, so that the fourth transistor is not conducted and the first transistor, the second transistor, the third transistor, the fifth transistor and the sixth transistor are conducted.

6. The pixel circuit of claim 5, wherein the first node has the first voltage, the second node has the second voltage, the third node has the third voltage and the fourth node has the fourth voltage; a reset current flowing from the first node through the first transistor to the second node is related to the second voltage, the third voltage and a threshold voltage of the first transistor.

7. The pixel circuit of claim 4, wherein during a second period, the LED is not conducted, the first control signal and the second control signal are at low-level and the third control signal is at high-level, so that the second transistor and the fourth transistor are not conducted and the first transistor, the third transistor, the fifth transistor and the sixth transistor are conducted.

8. The pixel circuit of claim 7, wherein the first node has the first voltage, the second node has a voltage equal to the third voltage minus a threshold voltage of the first transistor, the third node has the third voltage and the fourth node has the fourth voltage; a cross-voltage across the capacitor equal to the fourth voltage minus the third voltage and plus the threshold voltage of the first transistor.

9. The pixel circuit of claim 4, wherein during a third period, the LED is conducted, the first control signal and the second control signal are at high-level and the third control signal is at low-level, so that the third transistor, the fifth transistor and the sixth transistor are not conducted and the first transistor, the second transistor and the fourth transistor are conducted.

10. The pixel circuit of claim 9, wherein a light-emitting diode current flowing the LED is related to the fourth voltage and the third voltage.

11. The pixel circuit of claim 1, wherein when the pixel circuit is operated in a second compensation mode, another terminal of the sixth transistor is coupled to a sensing line of the uLED display.

12. The pixel circuit of claim 11, wherein the first control signal and the third control signal are at high-level and the second control signal is at low-level, so that the fourth transistor is not conducted and the first transistor, the second transistor, the third transistor, the fifth transistor and the sixth transistor are conducted, and the LED is not conducted, the sensing line provides a detection current flowing through the sixth transistor, the first node, the first transistor, the second node and the second transistor in order, and the detection current is related to the second voltage, the third voltage and a threshold voltage of the first transistor.

13. The pixel circuit of claim 11, wherein the first control signal and the second control signal are at low-level and the third control signal is at high-level, so that the first transistor, the second transistor and the fourth transistor are not conducted and the third transistor, the fifth transistor and the sixth transistor are conducted, the LED is conducted, a reference current flows through the LED, the first node, the sixth transistor and the sensing line to form a sensing voltage, and the sensing voltage is related to the first voltage and a cross-voltage across the LED.

14. A pixel circuit operating method for operating a pixel circuit applied to a micro light-emitting diode (uLED) display, the pixel circuit comprising a light-emitting diode (LED), a first transistor, a second transistor, a third transistor, a fourth transistor, a fifth transistor, a sixth transistor and a capacitor; the LED, the first transistor and the second transistor being coupled in series between a first voltage and a second voltage lower than the first voltage; the third transistor, the fourth transistor and the fifth transistor being coupled in series between a third voltage and a fourth voltage; the sixth transistor being coupled to a first node between the LED and the first transistor and the capacitor being coupled to a second node between the first transistor and the second transistor; a gate of the first transistor being coupled to a third node between the third transistor and the fourth transistor and the capacitor being also coupled to a fourth node between the fourth transistor and the fifth transistor, the pixel circuit operating method comprising steps of:

providing a first control signal to the second transistor to control the operation of the second transistor;

providing a second control signal to the fourth transistor to control the operation of the fourth transistor; and providing a third control signal to the third transistor, the fifth transistor and the sixth transistor to control the operation of the third transistor, the fifth transistor and the sixth transistor.

15. The pixel circuit operating method of claim 14, wherein when the pixel circuit is operated in a first compensation mode, the sixth transistor is also coupled to the first voltage; when the pixel circuit is operated in a second compensation mode, the sixth transistor is also coupled to a sensing line of the uLED display.

16. The pixel circuit operating method of claim 15, wherein under the first compensation mode, the pixel circuit operating method further comprises a step of:

during a first period, turning off the LED and controlling the first control signal and the third control signal at high-level and the second control signal at low-level, so that the fourth transistor is not conducted and the first transistor, the second transistor, the third transistor, the fifth transistor and the sixth transistor are conducted;

wherein the first node has the first voltage, the second node has the second voltage, the third node has the third voltage and the fourth node has the fourth voltage; a reset current flowing from the first node through the first transistor to the second node is related to the second voltage, the third voltage and a threshold voltage of the first transistor.

17. The pixel circuit operating method of claim 15, wherein under the first compensation mode, the pixel circuit operating method further comprises a step of:

during a second period, turning off the LED and controlling the first control signal and the second signal at low-level and the third control signal at high-level, so that the second transistor and the fourth transistor are not conducted and the first transistor, the third transistor, the fifth transistor and the sixth transistor are conducted;

wherein the first node has the first voltage, the second node has a voltage equal to the third voltage minus a threshold voltage of the first transistor, the third node has the third voltage and the fourth node has the fourth voltage; a cross-voltage across the capacitor equal to the fourth voltage minus the third voltage and plus the threshold voltage of the first transistor.

18. The pixel circuit operating method of claim 15, wherein under the first compensation mode, the pixel circuit operating method further comprises a step of:

during a third period, turning on the LED and controlling the first control signal and the second signal at high-level and the third control signal at low-level, so that the third transistor, the fifth transistor and the sixth transistor are not conducted and the first transistor, the second transistor and the fourth transistor are conducted;

wherein a LED current flowing through the LED is related to the fourth voltage and the third voltage.

19. The pixel circuit operating method of claim 15, wherein under the second compensation mode, the pixel circuit operating method further comprises steps of:

turning off the LED and controlling the first control signal and the third signal at high-level and the second control signal at low-level, so that the fourth transistor is not conducted and the first transistor, the second transistor, the third transistor, the fifth transistor and the sixth transistor are conducted; and using the sensing line to provide a detection current flowing through the sixth transistor, the first node, the first transistor, the second node and the second transistor in order;

wherein the detection current is related to the second voltage, the third voltage and a threshold voltage of the first transistor.

20. The pixel circuit operating method of claim 15, wherein under the second compensation mode, the pixel circuit operating method further comprises steps of:

turning on the LED and controlling the first control signal and the second signal at low-level and the third control signal at high-level, so that the the first transistor, the second transistor and the fourth transistor are not conducted and the third transistor, the fifth transistor and the sixth transistor are conducted; and providing a reference current to flow through the LED, the first node, the sixth transistor and the sensing line to form a sensing voltage;

wherein the sensing voltage is related to the first voltage and a cross-voltage across the LED.

* * * * *